US006378820B1

(12) United States Patent
Mooney et al.

(10) Patent No.: US 6,378,820 B1
(45) Date of Patent: Apr. 30, 2002

(54) APPARATUS AND METHOD FOR MOUNTING BANNERS

(75) Inventors: Steve D. Mooney, Wayzata; George H. Pfeffer, Minneapolis, both of MN (US)

(73) Assignee: Mooney & Company, Wayzata, MN (US)

( * ) Notice: Subject to any disclaimer, the term of this patent is extended or adjusted under 35 U.S.C. 154(b) by 0 days.

(21) Appl. No.: 09/433,483

(22) Filed: Nov. 4, 1999

Related U.S. Application Data

(60) Provisional application No. 60/107,176, filed on Nov. 5, 1998.

(51) Int. Cl.[7] ..... F21V 21/00

(52) U.S. Cl. ..... 248/218.4; 40/604; 116/173; 248/292.13; 248/230.8

(58) Field of Search ..... 248/218.4, 219.1, 248/219.4, 292.13, 689; 116/173, 174; 40/604, 607; 160/327, 329, 391, 378; 211/101, 111

(56) References Cited

U.S. PATENT DOCUMENTS 3,241,516 A * 3/1966 Hopkins ..... 116/173
3,416,477 A * 12/1968 Gunderson ..... 116/173
3,850,401 A * 11/1974 Snediker ..... 248/292.13
4,080,925 A * 3/1978 Moore ..... 116/200
4,920,910 A * 5/1990 Lin ..... 40/610 X
5,388,794 A 2/1995 Wolff
5,964,401 A * 10/1999 Thill ..... 232/35

* cited by examiner

*Primary Examiner*—Ramon O Ramirez
*Assistant Examiner*—Tan Le
(74) *Attorney, Agent, or Firm*—Skinner & Associates

(57) ABSTRACT

An apparatus for mounting a banner, comprising an arm and a base. The arm includes a proximal portion, a distal portion adapted for holding the banner, and a spring portion connecting the proximal portion to the distal portion. The base is adapted for attaching the proximal portion of the arm to a structure. The apparatus may be used in a banner hanging system, comprising at least two arms adapted for holding a banner and a set of two bases. One of the arms is adapted for holding a top end of the banner and the other of the arms is adapted for holding a bottom end of the banner. Each of the two bases may include two opposing receiver portions, each receiver portion being adapted for receiving and being attached to the proximal end of one of the arms. The opposing receiver portions are constructed and arranged to extend banners on opposing sides of the structure. The invention further includes a method for employing spring arms to hang a banner on a structure, comprising the steps of: attaching a first spring arm to a structure at a predetermined position; attaching a second spring arm to the structure at a predetermined position with respect to the first spring arm; attaching a first edge of the banner to the first spring arm; flexing the second spring arm; attaching the second edge of the banner to the second spring arm; and relaxing the second spring arm to pull the banner taut between the first and the second spring arms.

10 Claims, 4 Drawing Sheets

APPARATUS AND METHOD FOR MOUNTING BANNERS

CROSS-REFERENCE TO RELATED APPLICATIONS, IF ANY

This application claims the benefit under 35 U.S.C. §119 (e) of provisional application Serial No. 60/107,176, filed Nov. 05, 1998.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention.

The present invention relates, generally, to apparatus and methods for mounting articles. More particularly, the invention relates to apparatus and methods for mounting banners on outdoor structures.

2. Background Information.

The state of the art in general includes various apparatus and methods for mounting banners. These apparatus and methods are believed to have significant limitations and shortcomings, particularly with respect to strong wind loads. A strong wind load may tear the banner from the structure, such as a pole or building, upon which it was attached. High strength fiberglass rods have been used to hang the banners as they are intended to permit frequent flexing without failure. However, these rods often do not flex enough in response to wind loads to prevent the banners from been torn off of the structure. Furthermore, if the banner is not taut, the wind may tear the banner itself. One method of keeping the banner taut across its width is to cant the banner poles, whereby the spacing between poles increases as the pole ends are approached to provide tension at the far or distal edge of the banner.

This invention provides an apparatus and method for mounting banners which is believed to constitute an improvement over existing technology.

BRIEF SUMMARY OF THE INVENTION

The present invention provides an apparatus and method for mounting banners. The apparatus for mounting banners generally comprises an arm and a base. The arm includes a proximal portion, a distal portion adapted for holding the banner, and a spring portion connecting the proximal portion to the distal portion. The base attaches the proximal portion of the arm to a structure. The spring portion permits both vertical and horizontal motion in the distal portion of the arm in response to wind loads.

The apparatus may be used with others in a banner hanging system, which generally comprises at least two arms adapted for holding a banner and a set of two bases. One of the arms is adapted for holding a top end of the banner and the other of the arms is adapted for holding a bottom end of the banner. In one preferred embodiment, each of the two bases include two opposing receiver portions, each being adapted for receiving and attaching to the proximal end of one of the arms. The receiver portions are constructed and arranged to extend banners on opposing sides of a pole.

The invention further includes a method for employing spring arms to hang banners, generally comprising the steps of: attaching a first spring arm to a structure at a predetermined position; attaching a second spring arm to the structure at a predetermined position with respect to the first spring arm; attaching a first edge of the banner to the first spring arm; flexing the second spring arm; attaching the second edge of the banner to the second spring arm; and relaxing the second spring arm to pull the banner taut between the first and the second spring arms.

The spring portion of the arm forms a joint proximate to the base and allows the arm to bend under strong wind loads. Thus, the banner is not torn from the structure during severe storms. Furthermore, the spring portion allows the arm or arms to be flexed or bent while stretching a taut banner across two arms. Additionally, opposing receiver portions in the base permit a single base to be mounted to the back of pole and further permit a banner to be attached to each receiver portion such that the banners hang on opposing sides of the pole.

The features, benefits and objects of this invention will become clear to those skilled in the art by reference to the following description, claims and drawings.

DETAILED DESCRIPTION

Figure 3:
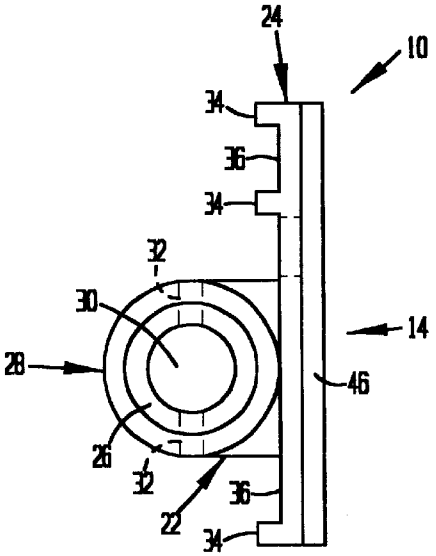
FIG. 3 is a view taken along line 3—3 of FIG. 1.
Figure 4:
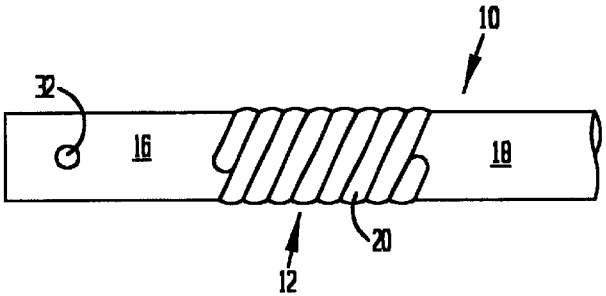
FIG. 4 is a partial view of the arm of the present invention.
Figure 1:
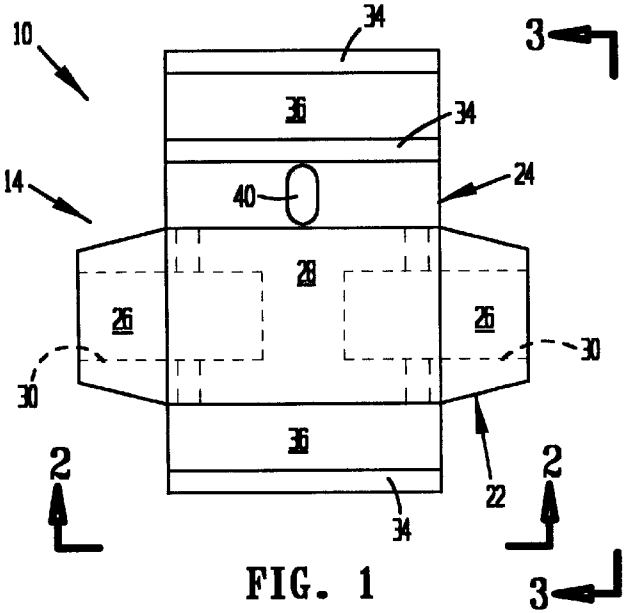
FIG. 1 is a front view of the base of the present invention.
Figure 2:
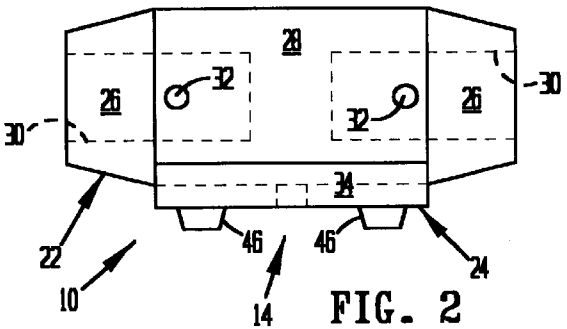
FIG. 2 is a view taken along line 2—2 of FIG. 1.

Referring to FIGS. 1–9, an example of the preferred embodiment of the present invention is illustrated and generally indicated by the reference numeral 10. The banner mounting apparatus 10 is described below first in terms of its major structural elements and then with respect to its use within a banner hanging system and with respect to a method for employing spring arms to hang banners.

Referring first to FIGS. 1–4, the banner mounting apparatus 10 generally comprises an arm 12 and a base 14, casting or bracket. The arm 12 is a spring arm and includes a proximal portion 16, a distal portion 18 adapted for holding a banner B, and a spring portion 20 connecting the proximal portion 16 to the distal portion 18.

Figure 5:
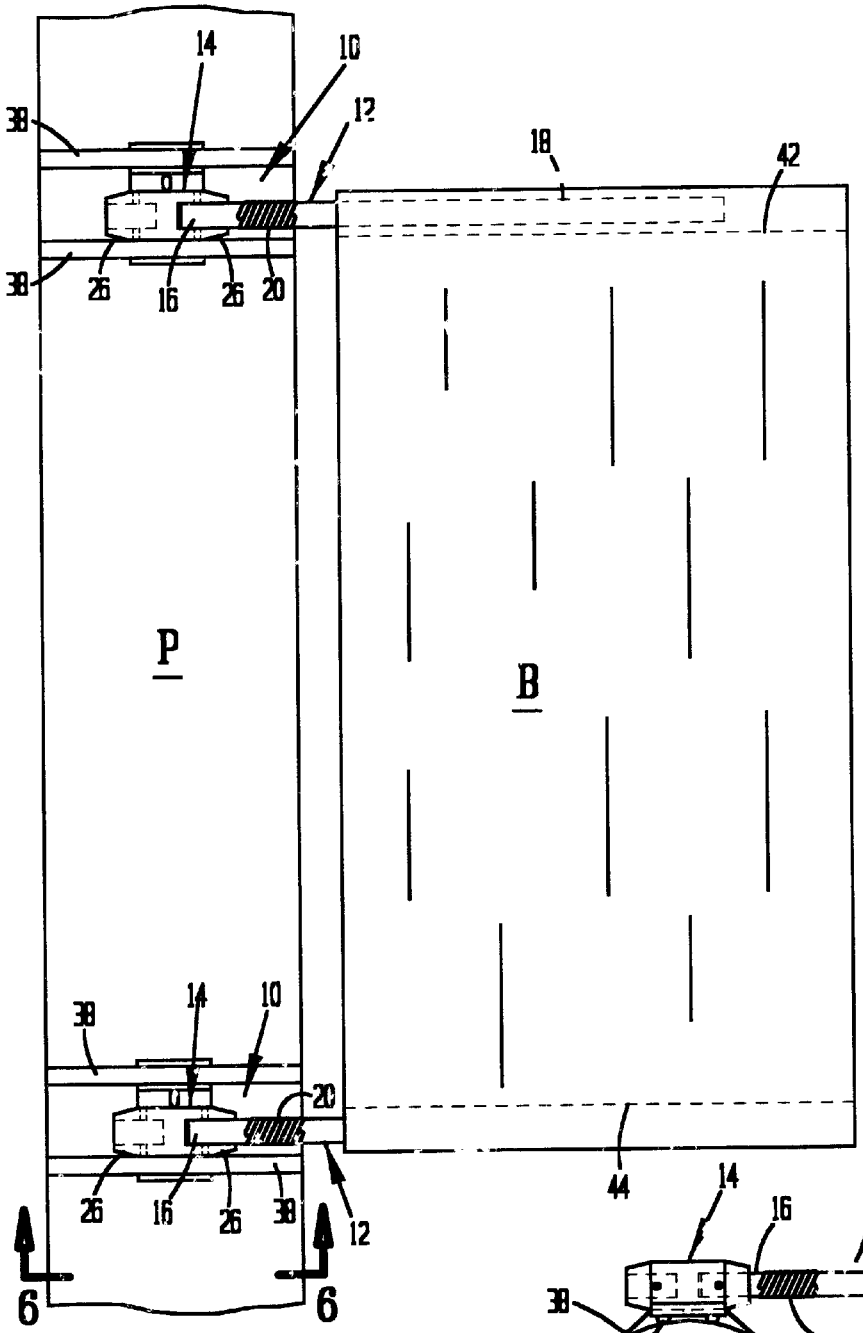
FIG. 5 is a front view of the banner hanging system of the present invention.
Figure 7:
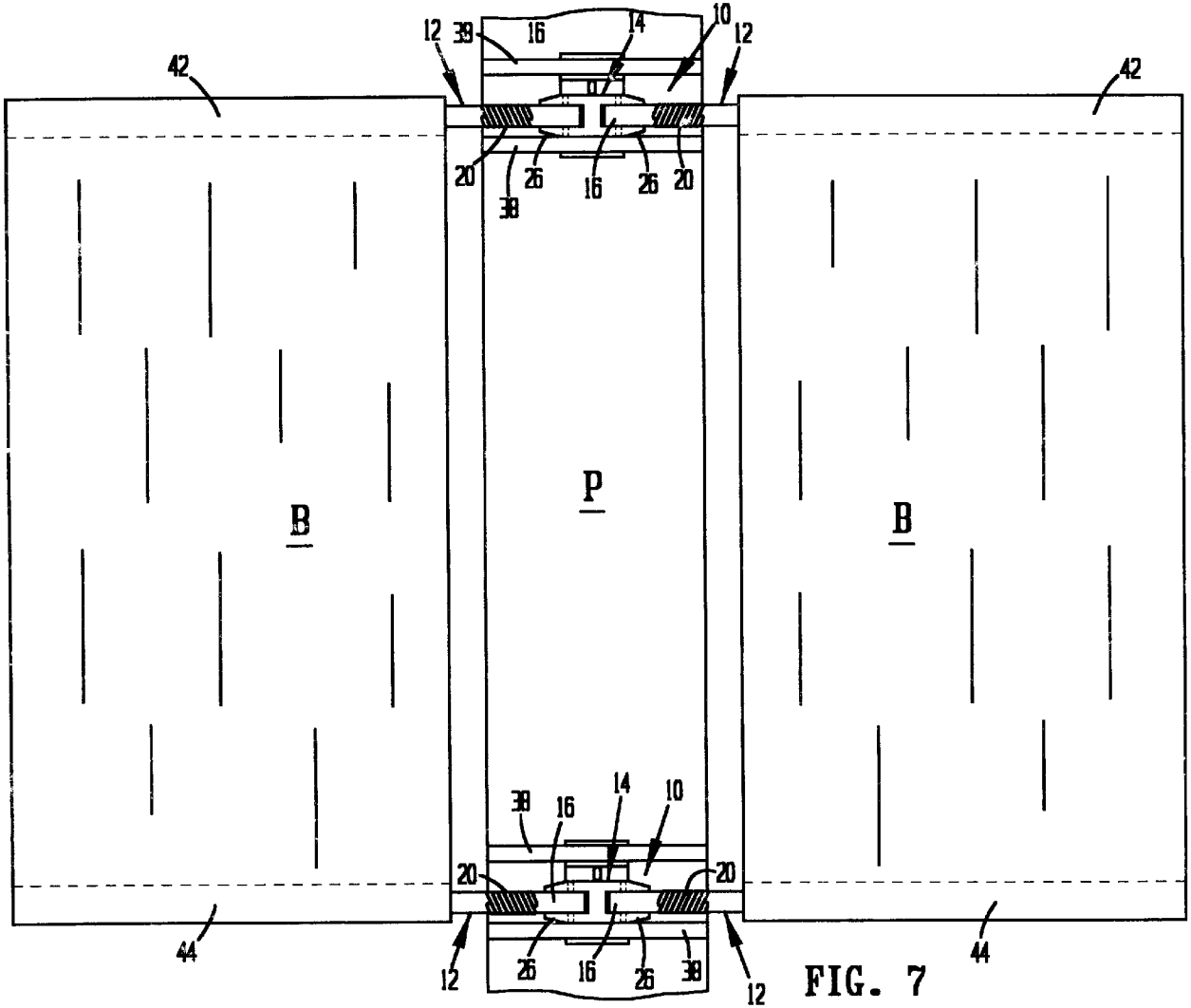
FIG. 7 is a front view of double banners hung by the banner hanging system of FIG. 5.
Figure 8:
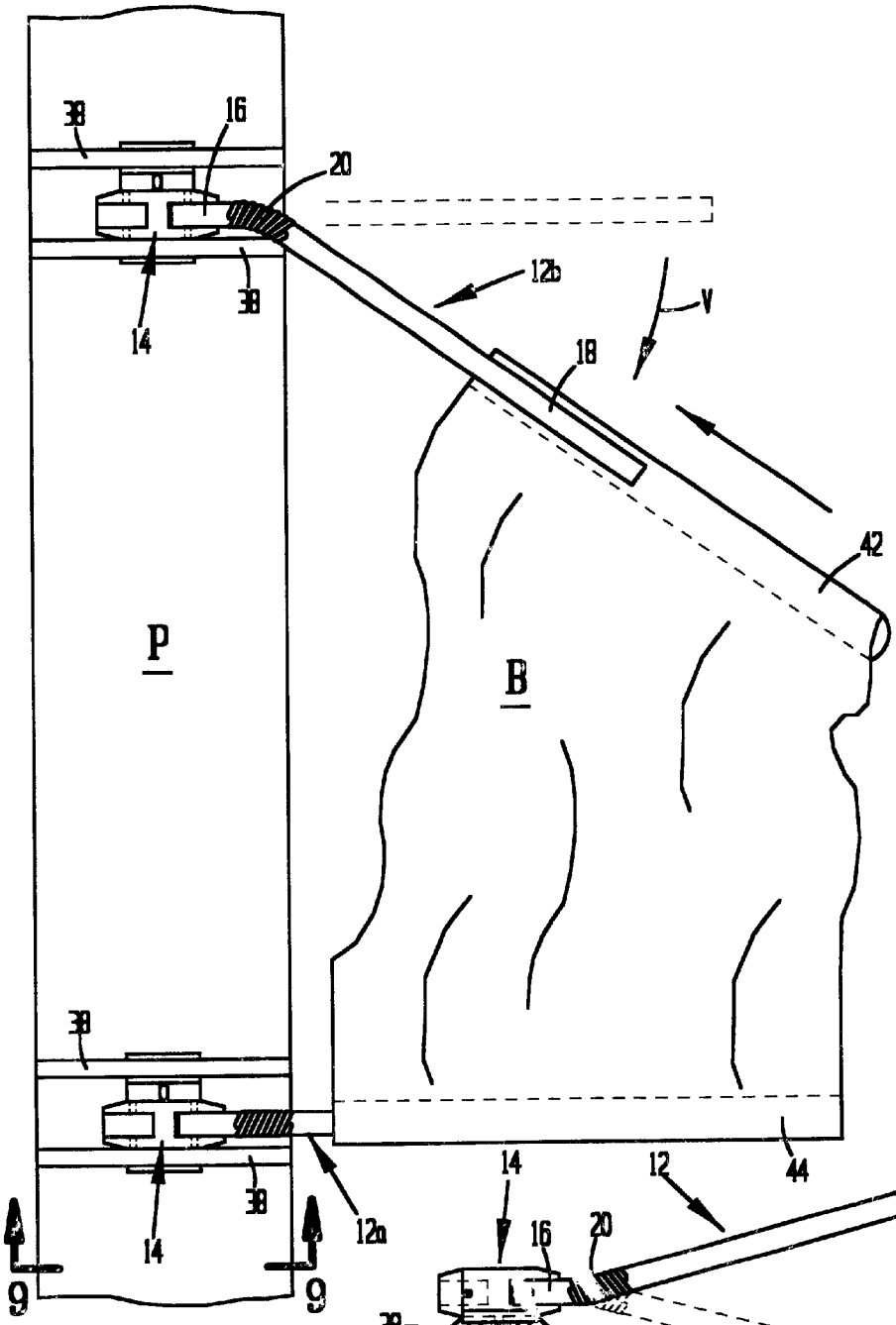
FIG. 8 illustrates a method of hanging a banner on a structure using the banner hanging system of FIG. 5, and further illustrates vertical motion in the distal portion of the arm.

The base 14 is adapted for attaching the proximal portion 16 of the arm 12 to a structure, such as a pole P or building. The base 14 generally comprises a mount 22 and a plate 24. The mount 22 has at least one receiver portion 26, and as illustrated in the figures, preferably has two opposing receiver portions 26. The receiver portions 26 have a generally tubular body 28 with openings 30 at each end. The openings 30 are sized and otherwise adapted for receiving the proximal portion 16 of the arm 12. Both the openings 30 and the proximal portions 16 are illustrated as having cylindrical shapes. The arm 12 is secured or attached to the mount 22 by inserting a cotter pin through aligned holding pin apertures 32 located in the tubular body 28 and the proximal portion 16 of the arm 12. The plate 24 is preferably formed with ribs 34 that define strap channels 36. As illustrated in FIGS. 5, 7 and 8, banding straps 38 may be placed within these channels 36 and then strapped around the pole P. The plate 24 may also incorporate one or more fastening apertures 40 through which the plate 24 may be screwed, bolted, nailed or otherwise fastened to the pole P, building or other structure. A pair of struts 46 formed beneath the plate 24 are adapted to provide a stable contact with the surface of the structure. As illustrated in the figures, the struts 46 preferably consist of parallel rails which may be aligned to be parallel with a vertical axis of a pole P, thus providing a stable contact or seat with the round surface of the pole P. The struts 46 also provide a stable contact with a flat surface such as a building wall.

In one embodiment, the base 14 is preferably constructed from 320 aluminum, although other strong, lightweight, and corrosion-resistant material may be used. The dimensions of the plate 24 are about 3 inches by 5 inches, the outer diameter of the mount 22 is 2 inches, and the cylindrically-shaped openings 30 have a diameter of 1 inch and a depth of 2 inches. The openings 30 may be formed to cause the arms 14 to extend slightly upward to compensate for the weight of the banner B. The openings 30 also may be formed to create a slight cant in the arms 12 to keep the banner B taut. Additionally, in this embodiment, the arm 12 is preferably constructed from a 39 inch fiberglass rod. The spring portion 20 is a stainless steel spring welded or otherwise attached at each end to stainless steel sleeves, not shown. Each sleeve is constructed and arranged to receive and be attached to either the proximal portion 16 or the distal portion 18 of the arm 12. Both the spring portion 20 and the proximal portion 16 are about 3 inches long. The spring 20 is preferably a helical spring that permits both vertical V and horizontal H motion in the distal portion 18. It is anticipated that other spring types may be used and that, depending on the material used, the spring portion could be formed as an integral part of the arm 12 rather than as a separate element.

Figure 6:
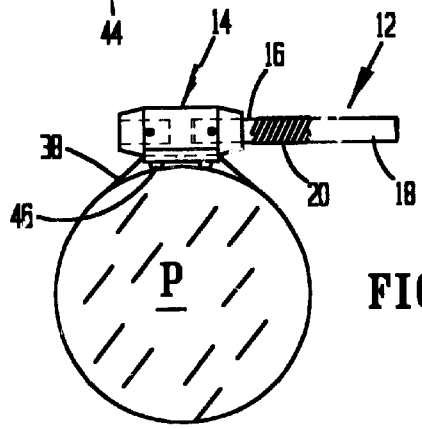
FIG. 6 is a cross-sectional view taken along line 6—6 of FIG. 5.

Referring now to FIGS. 5–7, the banner mounting apparatus 10 may be used in a banner B hanging system, generally comprising at least two arms 12 adapted for holding a banner B and a set of two bases 14. One of the arms is adapted for holding a top end of the banner B and the other of the arms is adapted for holding a bottom end of the banner B. As illustrated, the banner B preferably has a top or first hem 42 and a bottom or second hem 44 through which the distal portion 18 of the arm 12 extends. The proximal portion 16 of each arm 12 is attached to a base 14. Each of the bases 14 may include two opposing receiver portions 26, each of which being adapted for receiving and being attached to the proximal portion 16 of one of the arms 12. As shown in FIG. 7, the receiver portions 16 are constructed and arranged to extend banners B on opposing sides of a pole P.

Figure 9:
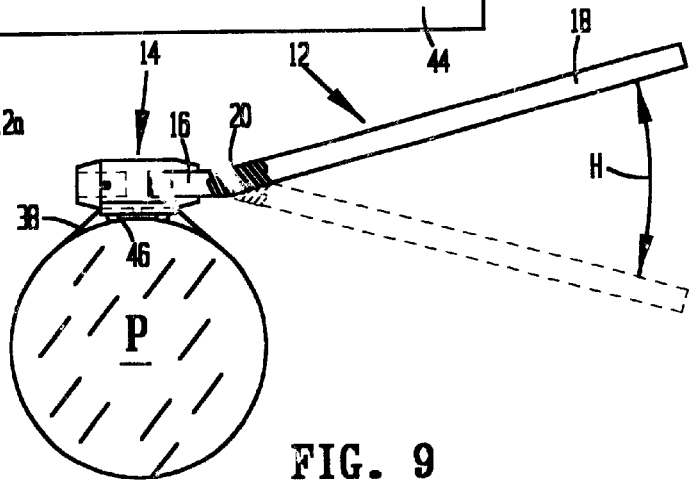
FIG. 9 is a cross-sectional view taken along line 9—9 of FIG. 8 and illustrates horizontal motion in the distal portion of the arm.

The spring arm 12 is responsive to potentially harmful wind loading because of the permitted vertical V and horizontal H motions of the distal portion 18 of the arm 12 as illustrated in FIGS. 8–9. The spring constant of the spring portion 20 may be chosen for a desired flexing response. Testing of the present invention has shown that it can withstand 70 mph straight line winds.

Referring again to FIG. 8, the invention further includes a method for hanging banners, generally comprising the steps of: attaching a first spring arm 12*a* to a structure P at a predetermined position; attaching a second spring arm 12*b* to the structure at a predetermined position with respect to the first spring arm 12*a*, wherein the distance between the arms corresponds to the length of the banner B; attaching a first edge of the banner to the first spring arm 12*a*; flexing the second spring arm 12*b*; attaching the second edge of the banner B to the second spring arm 12*b*; and relaxing the second spring arm 12*b* to pull the banner B taut between the first and the second spring arms 12*a* and 12*b*. The spring arms are attached to the structure by first attaching a base 14 to the structure, and then attaching a spring 12 arm to a receiver portion 26 of the base 14. The base 14 may be attached to the pole P using straps 38, or the base 14 may be screwed, bolted, nailed, or otherwise fastened directly to the structure. The banner B is attached to the arm 12 by sliding a hem 42 or 44 of the of banner B over the distal portion 18 of the arm 12 in the direction indicated the by arrow. Tie wraps, not shown, may be used to secure the banner B to the pole P.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. An apparatus for mounting banners to poles, comprising:

(a) an arm including a proximal portion, a distal portion adapted for holding a banner, and a spring portion connecting said proximal portion to said distal portion; and (b) a base adapted for attaching said proximal portion of said arm to a pole, said base including:

(i) a plate having a front surface, a back surface adapted for being disposed toward the pole, a top end, and a bottom end, said plate having a top strap guide disposed at the top end thereof, and a bottom strap guide disposed at the bottom end thereof, said plate further having at least two vertically oriented struts disposed on the back surface, said struts being horizontally separated whereby they are adapted for contacting the pole and stabilizing the position of the plate relative to the pole;

(ii) a receiver having a body connected to said plate, said receiver body having at least one horizontally oriented opening in which said distal portion of said arm is disposed at its end opposite said spring portion; and (iii) a top strap associated with said top strap guide, and a bottom strap associated with said bottom strap guide, said straps being adapted for holding the plate to the pole.

2. The apparatus of claim 1, wherein said spring portion is a helical spring.

3. The apparatus of claim 1, wherein said spring portion is adapted for permitting horizontal motion in said distal portion.

4. The apparatus of claim 1, wherein said spring portion is adapted for permitting vertical motion in said distal portion.

5. The apparatus of claim 1, wherein said banner has a hem, said distal portion of said arm sliding into said hem to hold said banner.

6. The apparatus of claim 1, wherein said proximal portion and said distal portion are rods and said spring portion is a helical spring attached between said rods.

7. The apparatus of claim 1, wherein said base each said strap guide consists of at least one horizontally oriented rib disposed on and extending from said front surface of said base plate, said ribs contacting and vertically restraining its respective said strap.

8. The apparatus of claim 1, further comprising a second arm, said receiver body have two horizontally oriented openings disposed in opposing directions, one of said arms being disposed in each said opening, whereby said receiver is arranged to extend banners on opposing horizontal sides.

9. A spring arm banner hanging system for use with a utility pole, comprising:

(a) a top unit including:

(1) an arm including a proximal portion, a distal portion adapted for holding a top of a banner, and a spring portion connecting said proximal portion to said distal portion; and (2) a base adapted for attaching said proximal portion of said arm to a pole, said base including:

(i) a plate having a front surface, a back surface adapted for being disposed toward the pole, a top end, and a bottom end, said plate having a top strap guide disposed at the top end thereof, and a bottom strap guide disposed at the bottom end thereof, said plate further having at least two vertically oriented struts disposed on the back surface, said struts being horizontally separated whereby they are adapted for contacting the pole and stabilizing the position of the plate relative to the pole;

(ii) a receiver having a body connected to said plate, said receiver body having at least one horizontally oriented opening in which said distal portion of said arm is disposed at its end opposite said spring portion; and (iii) a top strap associated with said top strap guide, and a bottom strap associated with said bottom strap guide, said straps being adapted for holding the plate to the pole; and (b) a bottom unit including:

(1) an arm including a proximal portion, a distal portion adapted for holding a bottom of a banner, and a spring portion connecting said proximal portion to said distal portion; and (2) a base adapted for attaching said proximal portion of said arm to a pole, said base including:

(i) a plate having a front surface, a back surface adapted for being disposed toward the pole, a top end, and a bottom end, said plate having a top strap guide disposed at the top end thereof, and a bottom strap guide disposed at the bottom end thereof, said plate further having at least two vertically oriented struts disposed on the back surface, said struts being horizontally separated whereby they are adapted for contacting the pole and stabilizing the position of the plate relative to the pole below said top unit;

(ii) a receiver having a body connected to said plate, said receiver body having at least one horizontally oriented opening in which said distal portion of said arm is disposed at its end opposite said spring portion; and (iii) a top strap associated with said top strap guide, and a bottom strap associated with said bottom strap guide, said straps being adapted for holding the plate to the pole.

10. The banner hanging system of claim 9 wherein said top and bottom units each have at least two arms, and each of said bases thereof have two opposing receiver body opening attaching said proximal ends of said arms, whereby said system is arranged to extend two banners on opposing sides of the pole.

* * * * *